US009308406B2

(12) United States Patent
Dunster et al.

(10) Patent No.: US 9,308,406 B2
(45) **Date of Patent: *Apr. 12, 2016**

(54) AUTOMATIC FIRE EXTINGUISHING SYSTEM HAVING OUTLET DIMENSIONS SIZED RELATIVE TO PROPELLANT GAS PRESSURE

(75) Inventors: Robert G. Dunster, Slough (GB); Paul W. Weller, Slough (GB); Robert Pallant, Slough (GB); Francis T. Clarence, Egham (GB); John W. Porterfield, Jr., Raleigh, NC (US); Daniel R. MacLachlan, Wilson, NC (US)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 545 days.

This patent is subject to a terminal disclaimer.

(21) Appl. No.: 13/281,201

(22) Filed: Oct. 25, 2011

(65) Prior Publication Data

US 2013/0098637 A1 Apr. 25, 2013

(51) Int. Cl.

| | |
|---|---|
| ***A62C 35/00*** | (2006.01) |
| ***A62C 35/02*** | (2006.01) |
| ***A62C 11/00*** | (2006.01) |
| ***A62C 37/10*** | (2006.01) |
| ***A62C 35/58*** | (2006.01) |

(Continued)

(52) U.S. Cl.

CPC ..... *A62C 35/02* (2013.01); *A62C 13/003* (2013.01); *A62C 13/64* (2013.01); *A62C 13/66* (2013.01); *A62C 13/76* (2013.01); *A62C 35/023* (2013.01); *A62C 3/07* (2013.01)

(58) Field of Classification Search

CPC .... A62C 13/003; A62C 35/023; A62C 13/66; A62C 13/76

USPC ..... 169/30, 71, 9, 26, 29, 85, 88, 74, 76, 169/77, 35; 137/67, 68.11, 68.19, 68.29, 137/68.3; 222/3–5, 80–83, 83.5, 88; 239/309

See application file for complete search history.

(56) References Cited

U.S. PATENT DOCUMENTS

| | | | | |
|---|---|---|---|---|
| 1,452,657 | A | 4/1923 | Robinson | |
| 1,839,658 | A * | 1/1932 | Dugas | 169/44 |

(Continued)

FOREIGN PATENT DOCUMENTS

| | | |
|---|---|---|
| CN | 2032963 U | 2/1989 |
| CN | 2054339 U | 3/1990 |

(Continued)

OTHER PUBLICATIONS

Patent Examination Report No. 1 regarding AU Patent Application No. 201244106; dated Sep. 6, 2013; 5 pgs.

(Continued)

*Primary Examiner* — Len Tran
*Assistant Examiner* — Alexander Valvis
(74) *Attorney, Agent, or Firm* — Cantor Colburn LLP

(57) ABSTRACT

An automatic fire extinguishing system includes a canister having a central axis, an outlet port disposed on the canister, a dip tube disposed in the canister about the central axis and in partial fluid communication with the canister and coupled to the outlet port, a propellant gas mixture disposed within the canister; and a gaseous fire suppression agent disposed in the canister, wherein a diameter of the outlet port is sized relative to a pressure of the propellant gas mixture.

15 Claims, 5 Drawing Sheets

(51) Int. Cl.

| | |
|---|---|
| ***A62C 13/66*** | (2006.01) |
| ***A62C 13/64*** | (2006.01) |
| ***A62C 13/76*** | (2006.01) |
| ***A62C 13/00*** | (2006.01) |
| *A62C 3/07* | (2006.01) |

(56) References Cited

U.S. PATENT DOCUMENTS

| | | | | | |
|---|---|---|---|---|---|
| 2,908,334 | A | | 10/1959 | Duggan et al. | |
| 3,232,493 | A | | 2/1966 | Beard, Jr. | |
| 3,529,670 | A | | 9/1970 | Herbline | |
| 3,861,474 | A | * | 1/1975 | De Palma | 169/75 |
| 3,889,752 | A | | 6/1975 | Dunn | |
| 3,889,758 | A | | 6/1975 | Dunn | |
| 3,948,540 | A | * | 4/1976 | Meacham | 280/735 |
| 3,949,812 | A | | 4/1976 | Hay | |
| 4,007,858 | A | | 2/1977 | Shay | |
| 4,174,055 | A | * | 11/1979 | Capra et al. | 222/319 |
| 4,194,571 | A | | 3/1980 | Monte | |
| 4,296,817 | A | | 10/1981 | Monte | |
| 4,637,472 | A | | 1/1987 | Decima | |
| 4,854,343 | A | * | 8/1989 | Rilett | 137/543.19 |
| 4,889,189 | A | | 12/1989 | Rozniecki | |
| 5,038,866 | A | | 8/1991 | Kern et al. | |
| 5,609,210 | A | | 3/1997 | Galbraith et al. | |
| 5,613,562 | A | | 3/1997 | Galbraith et al. | |
| 5,808,541 | A | | 9/1998 | Golden | |
| 5,845,716 | A | | 12/1998 | Birk | |
| 5,992,528 | A | * | 11/1999 | Parkinson et al. | 169/6 |
| 5,996,699 | A | | 12/1999 | Sundholm | |
| 6,019,177 | A | | 2/2000 | Olander | |
| 6,257,341 | B1 | * | 7/2001 | Bennett | 169/85 |
| 6,702,033 | B1 | | 3/2004 | Mitchell et al. | |
| 7,128,163 | B1 | | 10/2006 | Rousseau et al. | |
| 7,143,834 | B2 | * | 12/2006 | Dolan | 169/37 |
| 7,182,881 | B2 | | 2/2007 | Kato et al. | |
| 7,900,709 | B2 | * | 3/2011 | Kotliar | 169/45 |
| 2002/0023967 | A1 | | 2/2002 | Wolfe | |
| 2004/0216903 | A1 | | 11/2004 | Wierenga et al. | |
| 2004/0226726 | A1 | | 11/2004 | Holland et al. | |
| 2005/0269111 | A1 | | 12/2005 | McLane, Jr. | |
| 2006/0131034 | A1 | | 6/2006 | Lahouati | |
| 2008/0128145 | A1 | | 6/2008 | Butz et al. | |
| 2009/0159300 | A1 | | 6/2009 | Fabre | |
| 2009/0188681 | A1 | | 7/2009 | Chang | |
| 2010/0116515 | A1 | | 5/2010 | Felten et al. | |
| 2010/0294522 | A1 | | 11/2010 | Rousseau et al. | |
| 2013/0098636 | A1 | | 4/2013 | Dunster et al. | |
| 2013/0098637 | A1 | | 4/2013 | Dunster et al. | |
| 2013/0098638 | A1 | | 4/2013 | Dunster et al. | |
| 2013/0098639 | A1 | | 4/2013 | Dunster et al. | |

FOREIGN PATENT DOCUMENTS

| | | | |
|---|---|---|---|
| CN | 1747765 | A | 3/2006 |
| CN | 2885317 | Y | 4/2007 |
| CN | 201186118 | Y | 1/2009 |
| CN | 102626544 | | 8/2012 |
| EP | 0231745 | | 8/1987 |
| EP | 1961458 | | 8/2008 |
| FR | 2888124 | | 1/2007 |
| GB | 365277 | A | 1/1932 |
| GB | 780331 | | 7/1957 |
| GB | 2233226 | A | 1/1991 |
| GB | 2255015 | A | 10/1992 |
| KR | 19920008550 | | 10/1992 |
| WO | 9315794 | A1 | 8/1993 |
| WO | 9526218 | A1 | 10/1995 |
| WO | 0012180 | | 3/2000 |
| WO | 0057959 | | 10/2000 |
| WO | 2004091730 | | 10/2004 |
| WO | 2006008436 | A1 | 1/2006 |
| WO | 2007059468 | | 5/2007 |

OTHER PUBLICATIONS

Austrialian Patent Exam Report No. 1 for AU 2012244133 (5 pages). Exam report issued Sep. 13, 2013.

AU Patent Exam Report No. 1. AU Application No. 2012244140 date of issue Aug. 23, 2013. (5 pages).

Korean Notice of Preliminary Rejection for KR Patent Application No. 10-2012-118332; mailing date of rejection Sep. 26, 2013. (4 pages).

KIPO Notice of Preliminary Rejection and English Language translation for KR Patent Application No. 10-2012-118330 mailed Sep. 26, 2013.

Search Report regarding related SG App. No. 201207743-4; dated Aug. 9, 2013; 7 pgs.

Written Opinion regarding related SG Application No. 201207743-4; dated Aug. 9, 2013; 10 pgs.

Canadian Office Action for application 2,792,661, mailed Jan. 21, 2014, 2 pages.

European Search Report for EP 12 19 0070; Mailed on Dec. 4, 2014; 11 pages.

Canadian Office Action dated Oct. 6, 2014 for Canadian Application No. 2,792,656; pp. 1-2.

Final Office Action for U.S. Appl. No. 13/281,199 dated Aug. 28, 2014; 7 pages.

Final Office Action for U.S. Appl. No. 13/281,203 dated May 14, 2015; 20 pages.

Final Office Action for U.S. Appl. No. 13/281,203 dated Sep. 9, 2014; 7 pages.

Final Office Action for U.S. Appl. No. 13/281,208 dated Sep. 10, 2014; 10 pages.

Non Final Office Action for U.S. Appl. No. 13/281,199 dated Jan. 14, 2015; 10 pages.

Non Final Office Action for U.S. Appl. No. 13/281,203 dated Jan. 8, 2015; 13 pages.

Non Final Office Action for U.S. Appl. No. 13/281,208 dated Jan. 26, 2015; 9 pages.

TW Taiwan Office Action dated Mar. 25, 2015 for Taiwan Application No. 101139351; Office action and Translation; pp. 1-9.

Chinese Search Report and Second Office Action for Application No. 201210585761.9 dated Aug. 5, 2015; 9 pages.

Non-Final Office Action for Application No. 13/281,203 dated Sep. 2, 2015; 9 pages.

* cited by examiner

AUTOMATIC FIRE EXTINGUISHING SYSTEM HAVING OUTLET DIMENSIONS SIZED RELATIVE TO PROPELLANT GAS PRESSURE

BACKGROUND OF THE INVENTION

The present invention relates to fire extinguishing systems, and more specifically, to systems and methods for an attitude insensitive high rate discharge extinguisher having outlet dimensions sized relative to a pressure of the propellant gas mixture.

Automatic Fire Extinguishing (AFE) systems deploy after a fire or explosion event has been detected. In some cases, AFE systems are deployed within a confined space such as the crew compartment of a military vehicle following an event. AFE systems typically use high speed Infra red (IR) and/or ultra violet (UV) sensors to detect the early stages of fire/explosion development. The AFE systems typically include a cylinder filled with an extinguishing agent, a fast acting valve and a nozzle, which enables rapid and efficient deployment of agent throughout the confined space. Conventional AFE systems are mounted upright within the vehicle to enable the entire contents to be deployed effectively at the extremes of tilt, roll and temperature experienced within military vehicles, for example. In order to maintain system efficacy, the nozzles are located such that they can provide an even distribution of the agent within the vehicle. For these types of systems this requirement can be met by adding a hose at the valve outlet which extends to the desired location within the vehicle. Though effective this measure adds an extra level of system complexity and therefore cost.

Several solutions exist that resolve the problems of a suppressor that is required to be mounted upright. For example, a pipe type extinguisher design can be mounted at any orientation within a vehicle and still provides an efficacious discharge of extinguishing agent against a vehicle fire or explosion challenge. The extinguisher would also work were the vehicle to assume any orientation prior to or during the incident. Rapid desorption of dissolved nitrogen (or other inert gas) from the fire extinguishing agent(s) forming a two phase mixture (e.g., a foam or mousse) substantially fills the volume within the extinguisher and causes the discharge of agent from the valve assembly. The formation of this two-phase mixture enables the fire extinguishing agent to be adequately discharged regardless of the extinguisher orientation. However, current solutions including the pipe design do not fully address attitude insensitive needs of confined spaces that experience the extremes of tilt, roll and temperature experienced within military vehicles.

BRIEF DESCRIPTION OF THE INVENTION

Exemplary embodiments include an automatic fire extinguishing system, including a canister having a central axis, an outlet port disposed on the canister, a dip tube disposed in the canister about the central axis and in partial fluid communication with the canister and coupled to the outlet port, a propellant gas mixture disposed within the canister; and a gaseous fire suppression agent disposed in the canister, wherein a diameter of the outlet port is sized relative to a pressure of the propellant gas mixture.

Additional exemplary embodiments include an automatic fire extinguishing system, including a canister having a central axis, an outlet port disposed on the canister, a dip tube disposed in the canister about the central axis and in partial fluid communication with the canister and coupled to the outlet port, a propellant gas mixture having a first propellant gas and a second propellant gas within the canister and a gaseous fire suppression agent disposed in the canister, wherein a diameter of the outlet port is sized relative to a pressure of the propellant gas mixture.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 1:
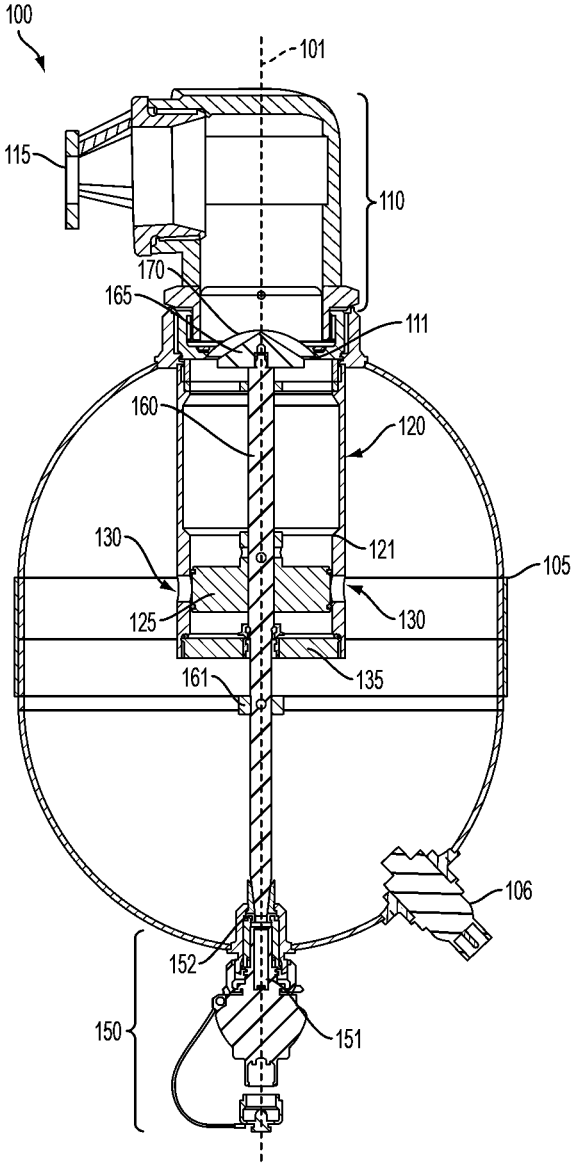
FIG. 1 illustrates a first view an automatic fire extinguishing (AFE) system in accordance with one embodiment.
Figure 2:
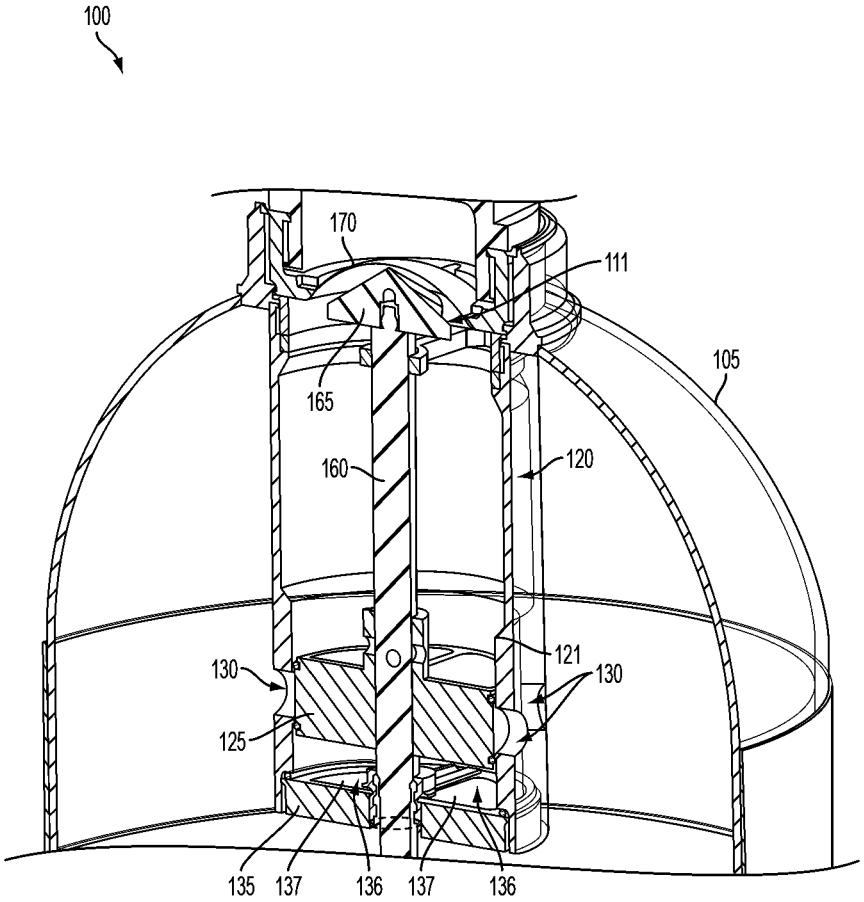
FIG. 2 illustrates a second view an AFE system in accordance with one embodiment.
Figure 3:
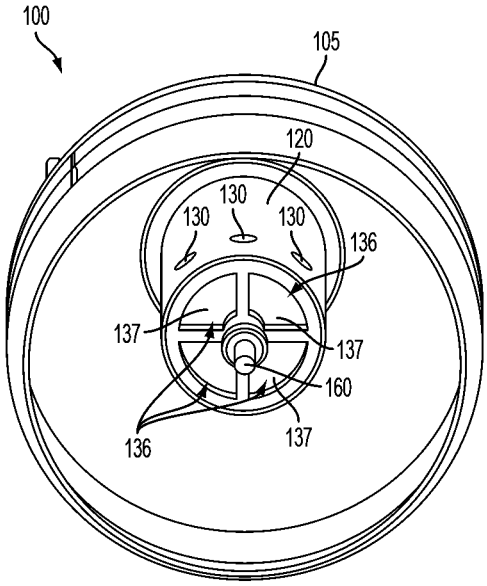
FIG. 3 illustrates a third view an AFE system in accordance with one embodiment.

FIG. 1 illustrates an automatic fire extinguishing (AFE) system 100 in accordance with one embodiment. FIG. 2 illustrates a close up perspective view of a portion of the system 100. FIG. 3 illustrates an internal view of the system 100. The system 100 is configured to rapidly disperse extinguishing agents within a confined space such as the crew compartment of a military vehicle following a fire or explosion event.

The system 100 includes a canister 105, which can be any suitable material such as stainless steel. The canister 105 is configured to receive both gaseous fire suppression agents and propellant gases (e.g., inert gases such as $N_2$). It can be appreciated that there are many conventional gaseous fire suppression agents are contemplated including but not limited to 1,1,1,2,3,3,3-heptafluoropropane (i.e., HFC-227ea (e.g., FM200®)), bromotrifluoromethane (i.e. BTM (e.g. Halon 1301) and 1,1,1,2,2,4,5,5,5-nonafluoro-4-(trifluoromethyl)-3-pentanone (i.e., FK-5.1.12 (e.g., Novec 1230®)). In addition, the canister 105 can include other propellant gas components (e.g., $CO_2$) as further described herein. The pressure in the canister 105 can be monitored via a switch 106 from a source of the gases (i.e., fire suppression agent and propellant gas). The system 100 further includes any suitable nozzle manifold 110 and nozzle 115 for directing and releasing extinguishing agents and propellant gas into the confined space. The system 100 further includes a dip tube 120 disposed within the canister 105. The dip tube 120 is configured to be in fluid communication with the canister 105 and the nozzle manifold 110 as further described herein. The dip tube 120 includes an internal ring 125 that is coupled to a central rod 160, which is disposed in the canister 105 and the dip tube 120 about a central axis 101. The central rod 160 includes a stop 161 having a radius larger than a radius of the central rod 160. The dip tube 120 includes a number of dip tube side holes 130 disposed around a circumference of the dip tube 120. The internal ring 125 convers the dip tube side holes 130 when the system 100 is in a closed and non-activated state. The dip tube 120 further includes an inlet port 135 having a number of openings 136, which are covered by a semi-permeable membrane 137. In addition, the canister 105 is hermetically sealed from the external environment. In addition, the dip tube 120 and the central rod 160 freely allow contents of the canister 105 to move around via the semi-permeable membrane 137. The dip tube 120 further includes a lip 121 having a radius greater than a radius of the internal ring 125. As further described herein, the dip tube 120 can include further extinguishing agents such as a dry powder fire suppression agent. It can be appreciated the dry powder fire suppression agent can include any conventional dry powder fire suppression agent including but not limited to potassium bicarbonate (i.e., $KHCO_3$ e.g. PurpleK™) and a sodium bicarbonate (i.e., $NaHCO_3$, e.g. KiddeX™) based extinguishing agent with additional silica to enhance the flow properties. It can be appreciated that the semi-permeable membrane 137 provides partial fluid and gaseous communication between the canister 105 and the dip tube 120. In this way, the dry powder extinguishing agent remains isolated within the dip tube 120. However, the propellant gases within the canister 105 can permeate the semi-permeable membrane 137 and keep the dip tube 120 pressurized at the same or substantially the same pressure as the canister 105.

An outlet port 111 is disposed between the canister 105 and the nozzle manifold 110, and is coupled to the dip tube 120. A broad cutting head 165 is coupled to the central rod 160 and positioned adjacent a burst disc 170 and covers the outlet port 111 when the system 100 is in the closed and non-activated state. The burst disc 170 maintains hermetically sealed isolation between contents of the canister 105 including the dip tube 120, and the nozzle manifold 110. As such, the canister 105 remains pressurized with respect to the external environment. The system 100 further includes an electric actuator 150 coupled to the canister 105. The electric actuator 150 is configured to on actuation mechanically couple to the central rod 160 disposed in the canister 105 and the dip tube 120. A mechanical pin 151 is coupled between the electric actuator 150 and the central rod 160. A diaphragm 152 hermetically seals the canister 105 from the external environment so that the compressed gases within the canister 105 do not escape.

Figure 4:
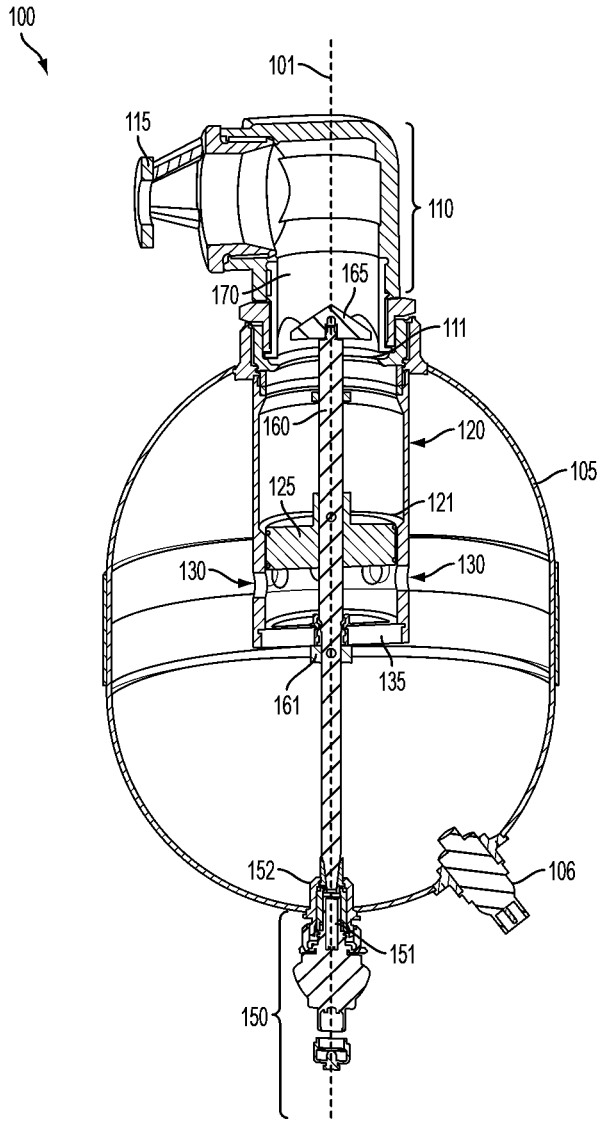
FIG. 4 illustrates a fourth view of an AFE system in an open and fully activated state.
Figure 5:
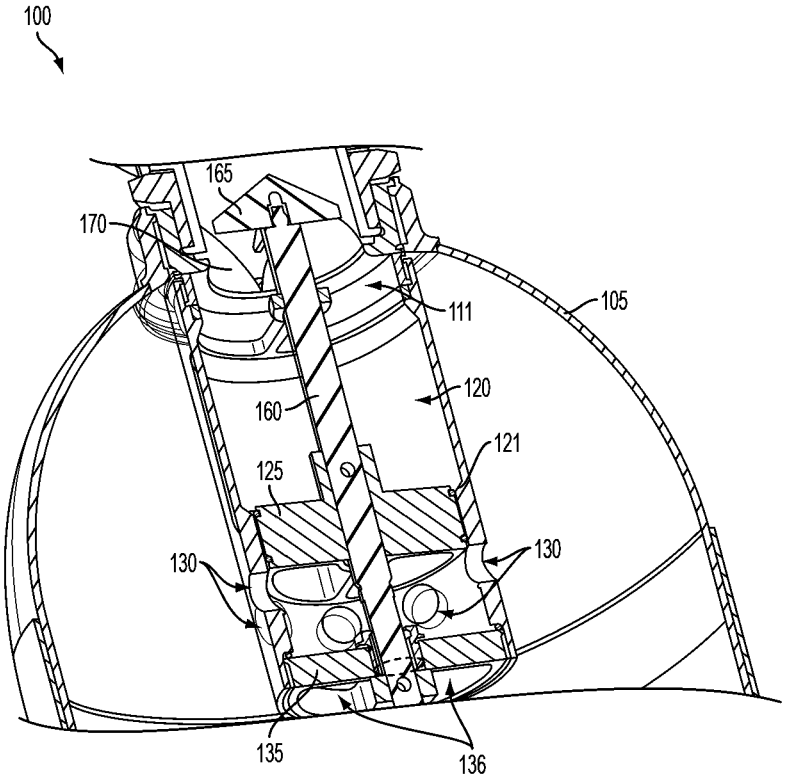
FIG. 5 illustrates a fifth view of an AFE system in an open and fully activated state.

In one embodiment, once the system 100 detects a fire or explosion event as described herein, the electric actuator 150 is activated, which drives the mechanical pin 151 through the diaphragm 152. The mechanical pin 151 further drives the central rod 160. Driving of the central rod 160 causes shifting of the internal ring 125 because the internal ring 125 is coupled to the central rod 160. The shifting of the internal ring 125 uncovers the internal ring 125 from the dip tube side holes 130. In addition, the driving of the central rod 160 drives the broad cutting head 165 through the burst disc 170. The system 100 then becomes in an open and activated state. The driving of the central rod 160 is limited when the stop 161 contacts the inlet port 135. When the system 100 is in the open and fully activated state, the pressurized canister 105 releases the pressurized gases into the external environment. The pressure differential between the canister 105 and the external environment causes the semi-permeable membrane 137 to fold out of the way, thereby exposing the inlet openings 136. When the system 100 is in the open and activated state, the canister 105 and the dip tube 120 are in full fluid communication. The dry powder extinguishing agent, which is pressurized in the dip tube 120 by the propellant gases and isolated from the canister 105, is released to the external environment, followed by the remaining propellant gases and the gaseous extinguishing agent, from the canister 105. FIGS. 4 and 5 illustrate the AFE system 100 in the open and fully activated state.

As described herein, the inert propellant gases can include $N_2$. Although 62 bar (g) (900 psig) of nitrogen overpressure, for example, can provide sufficient suppression efficiency when the canister 105 is filled with a design concentration of gaseous fire suppression agents and dry powder fire suppression agents, suppression performance and mass of agents out of the canister 105 can suffer at lower operating temperatures and varying attitudes of the canister 105. (e.g., the nozzle 115 facing upwards). In one embodiment, the overpressure of the $N_2$ can be increased above 62 bar (g) (900 psig). In addition, an additional propellant gas such as $CO_2$ is added to the $N_2$ propellant gas. By increasing the $N_2$ overpressure and by adding $CO_2$, the extinguishing performance and the total mass out of extinguishing agent are both enhanced. For example, a smaller scale experiment in a container partially filled with FM200® illustrated that 4.3 g (0.1 mole) of $CO_2$ is required to produce a 10 bar (g) overpressure. When the experiment is repeated with nitrogen only 0.7 g (0.025 mole) was added to achieve the same pressure. This result shows that $CO_2$ is significantly more soluble in FM200® than $N_2$. By analogy therefore the rate of desorption of $CO_2$ from FM200® is significantly greater than for $N_2$ during the discharge of a suppressor, such as the system 100. However, above certain limits $CO_2$ is known to be toxic to humans (i.e., the OSHA, NIOSH, and ACGIH occupational exposure standards are 0.5 vol % $CO_2$ averaged over a 40 hour week, 3 vol % average for a short-term (15 minute) exposure, and 4 vol % as the maximum instantaneous limit considered immediately dangerous to life and health). As such, in one embodiment, the system 100 includes an amount of $CO_2$ limited to give less than 2 vol % within the protected zone, which should cause no harmful effects to occupants for the short duration of these types of events. It can be appreciated that the addition of $CO_2$ within the $N_2$ propellant gas improves the rate of desorption of the pressurising gases from the bulk gaseous fire suppression agent. The violent reaction forms a two phase mixture (e.g., a foam or mousse) that substantially fills the volume of the canister 105 and allows agent to exit when the system 100 is in the open and activated state. This feature is the primary mechanism for releasing agent from the canister 105 and enhances the mass of agent discharged and suppression performance. In addition, by adding a portion of $CO_2$, the overall extinguishing performance (i.e. heat capacity) of the fire suppression agents is increased by a small amount. In one embodiment, since the $CO_2$ is more soluble in the gaseous fire suppression agent than $N_2$, the gaseous fire suppression agent is first added to the canister 105, followed by the $CO_2$, then the $N_2$. In one embodiment, up to 20 bar (g) (290 psig) of the $CO_2$ is added followed by the overpressure of up to 62 bar (g) (900 psig). Although the addition of $CO_2$ mixed with $N_2$ within the canister 105 filled with a combination of gaseous fire suppression agents and dry powder fire suppression agents has been described, it can be appreciated that other inert gases and volatile/vaporising liquid extinguishing agents (e.g. an extinguishing agent which contains a portion of liquid and gas when stored) is also contemplated in other embodiments. Some examples of other inert gases used to pressurise high rate discharge type extinguishers include but are not limited to helium, argon and Argonite®. It is possible that air could also be used as the pressurising gas. Other extinguishing agents can include but are not limited to Halon 1301, Halon 1211, FE36, FE25, FE13 and PFC410 and Novec 1230.

In one embodiment, dimensions of the outlet port 111 can be varied. In the confined spaces described herein, certain parameters are set in order to meet requirements of the confined space. For example, the addition of $CO_2$ and increase in charge pressure as mentioned as described herein results in enhanced suppression performance and a higher mass of agent discharged. However, certain limits of the confined space (e.g., peak sound levels tolerable by humans) can be surpassed. In one embodiment, the diameter of the outlet port 111 can be adjusted while maintaining suppression performance. For example, when the canister 105 is filled with a recommended design amount of gaseous fire suppression agent and dry powder fire suppression agent, and partially pressurised to 15 bar (g) (218 psig) with $CO_2$ and then fully pressurised to 76 bar (g) (1100 psig) with $N_2$, adequate suppression capabilities are met with an outlet port 111 size of 38-40 mm. If the outlet port was smaller than the agent mass flow rate and therefore suppression performance fell below acceptable limits. If the outlet port size is larger, one or more of the confined space limits would be overcome (i.e. suppressor became too loud or too much impact force from the extinguishing agent). In one embodiment, a relationship between the outlet port 111 size and the gaseous and dry powder fire suppression agents can vary. For example, for a 62 bar (g) (900 psig), filled with $N_2$ only, a sufficient outlet port 111 size is 50-55 mm diameter. This relationship can change depending on the extinguishing agents and pressurising gases used plus the overpressure used. In one embodiment, the system 100 is a high rate discharge (HRD) type extinguisher that implements inert propelling gas as the primary mechanism for discharging the agent from the canister 105.

As described herein, in one embodiment, the canister 105 can include a gaseous fire suppression agent and propellant gases. In addition, the dip tube 120 can include a dry powder fire suppression agent. In this way, the dip tube 120 ensures delivery of a dry powder fire suppression agent at the early stages of the discharge regardless of the orientation of the system 100, thereby providing the attitude insensitive features of the system 100. As shown in FIGS. 1-3, the dip tube 120 holds the dry powder fire suppression agent close to the outlet port 111 regardless of the orientation (i.e., attitude) of the system 100. As described herein, the semi-permeable membrane 137 enable the mixture of the propellant gas(es) (e.g., the $CO_2$ and the $N_2$) as well as the gaseous fire suppression agent to form within the interstices of the dry powder fire suppression agent structure. When the system is placed into its open and activated state, the dry powder fire suppression agent is discharged at the early stages of the overall extinguisher discharge. The fact that this dry powder fire suppression agent reaches an expanding fireball in the early stages has been shown to both improve extinguishing performance and reduce the quantity of acid gas generated. As described herein, the dry powder fire suppression agent can include any conventional dry powder fire suppression agent, as long as it is chemically compatible with all the other agents within the container, including but not limited to potassium bicarbonate (i.e., $KHCO_3$, e.g. Purple K™) and a sodium bicarbonate (i.e., $NaHCO_3$, e.g. KiddeX™) based extinguishing agent with additional silica to enhance the flow properties.

As described herein, in one embodiment, the dip tube 120 can be customized to provide adequate attitude insensitive delivery of the gaseous fire suppression agent and the dry powder fire suppression agent, which can be a particular issue in cold storage conditions. As described herein, the dip tube 120 includes a series of dip tube side holes 130 as well as inlet openings 136. The dip tube side holes 130 are adjacent the inlet port 135 and the inlet openings 136. In one embodiment, by altering the ratio of areas between the inlet port 135 (via the inlet openings 136) and dip tube side holes 130 relative to the outlet port 111 of the canister 105, the discharge characteristics can be adjusted to provide very similar properties regardless of attitude or operating temperature. The adjustments also maintain adequate suppression performance and meet confined space requirements. Examples of the dip tube 120 design are based around an outlet port 111 diameter of 40 mm. For example, the area of the inlet openings 136 is 100% of the area of the outlet port 111, and the area of the dip tube side holes 130 is further 50% of the area of the outlet port 111. In another example, the area of the inlet openings 136 is 50% of the outlet port 111 and the area of the dip tube side holes 130 is 100% of the area of the outlet port 111. In both examples, the sum of the areas of the inlet openings 136 and area of the dip tube side holes 130 is 150% of the area of the outlet port 111. It can be appreciated that the dip tube 120 can include no dip tube side holes 130. However, an initial discharge of the dry powder fire suppression agent and a slug of the gaseous fire suppression agent, which changes from a liquefied state to gaseous upon discharge, can result in a reduction in the mass flow rate and density of agent from the outlet port 111 whilst the gaseous fire suppression agent still is forming into a two phase solution within the canister 105. By including a dip tube with side holes 130 and controlling the relative proportions of the areas within the dip tube 120 design, the time taken to discharge agent from the canister 105 with two-phase agent is reduced. As a result after the initial discharge of dry chemical from the canister 120 an enhanced mass flow rate of gaseous extinguishing agent is maintained whilst the gaseous fire suppression agent still is forming into a two phase solution within the canister 105. This less restrictive path of flow maximises the mass out of extinguishing agent per unit of pressure decay during the discharge. As such, a high degree of attitude insensitivity is displayed by the system 100 even at the lower operating temperatures.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An automatic fire extinguishing system, comprising:

a canister having a central axis;

an outlet port disposed on the canister;

a dip tube disposed in the canister about the central axis and in partial fluid communication with the canister and coupled to the outlet port, the dip tube including an inlet port on an end opposite the outlet port, the dip tube including at least two holes disposed about the circumference of the dip tube;

a semi-permeable membrane is disposed over the inlet port, the semi-permeable membrane configure to move from a closed position to an open position when the propellant gas mixture is discharged in operation;

a rod extending axially through the dip tube and through the semi-permeable membrane, the rod being operably coupled to the canister opposite the inlet port, the rod movable from a first position to a second position;

a ring member coupled to the rod and disposed within the dip tube, wherein the ring member closes the at least two holes when the rod is in the first position and opens the at least two holes when the rod is in the second position;

a propellant gas mixture disposed within the canister; and a gaseous fire suppression agent disposed in the canister, an electric actuator coupled to the canister opposite the outlet port, the electric actuator being at least partially external to the canister;

a diaphragm disposed between the electric actuator and the rod; and a pin coupled between the electric actuator and the rod, the pin arranged to extend through the diaphragm and move the rod from the first position to the second position when the electric actuator is activated;

wherein a diameter of the outlet port is sized relative to a pressure of the propellant gas mixture to discharge when the rod is in the second position a mixture of the propellant gas mixture and gaseous fire suppression agent from the outlet port within predetermined vehicle confined space parameter threshold.

2. The system as claimed in claim 1 wherein the pressure of the propellant gas mixture is 76 bar (g) (1100 psig).

3. The system as claimed 2 wherein the diameter of the outlet port is 38-40 mm.

4. The system as claimed in claim 1 wherein the pressure of the propellant gas mixture is 62 bar (g) (900 psig).

5. The system as claimed 4 wherein the diameter of the outlet port is 50-55 mm.

6. The system as claimed in claim 1 further comprising:

a broad head cutter disposed on the rod; and a burst disc disposed in the outlet port and adjacent the broad head cutter, wherein the broad head cutter is further configured to extend at least partially through the burst disc when the rod moves from the first position to the second position.

7. An automatic fire extinguishing system for a vehicle having a confined space that includes a predetermined protected zone, the system comprising:

a canister having a central axis;

an outlet port disposed on the canister;

a dip tube disposed in the canister about the central axis and in partial fluid communication with the canister and coupled to the outlet port, the dip tube including an inlet port on an end opposite the outlet port, the dip tube having a plurality of holes arranged adjacent the inlet port;

a semi-permeable membrane is disposed over the inlet port, the semi-permeable membrane configure to move from a closed position to an open position when the propellant gas mixture is discharged in operation;

a rod extending axially through the dip tube and through the semi-permeable membrane, the rod being operably coupled to the canister opposite the outlet port, the rod movable from a first position to a second position;

a ring member coupled to the rod and arranged within the dip tube, wherein the ring member is arranged to close the plurality holes when the rod is in the first position and opens the plurality holes when the rod is in the second position;

a propellant gas mixture having a first propellant gas and a second propellant gas within the canister, the second propellant gas being $CO_2$, the amount of $CO_2$ being less than or equal to 2 vol % within a predetermined protected zone; and a gaseous fire suppression agent disposed in the canister, an electric actuator coupled to the canister opposite the outlet port, the electric actuator being at least partially external to the canister;

a diaphragm disposed between the electric actuator and the rod; and a pin coupled between the electric actuator and the rod, the pin arranged to extend through the diaphragm and move the rod from the first position to the second position when the electric actuator is activated, the pin being arranged co-axial with the rod;

wherein a diameter of the outlet port is sized relative to a pressure of the propellant gas mixture to discharge when the rod is in the second position a mixture of the propellant gas mixture and gaseous fire suppression agent from the outlet port within predetermined vehicle confined space parameter threshold.

8. The system as claimed in claim 7 wherein the pressure of the propellant gas mixture is 76 bar (g) (1100 psig).

9. The system as claimed 8 wherein the diameter of the outlet port is 38-40 mm.

10. The system as claimed in claim 7 wherein the pressure of the propellant gas mixture is 62 bar (g) (900 psig).

11. The system as claimed 10 wherein the diameter of the outlet port is 50-55 mm.

12. The system as claimed in claim 7 further comprising:

a broad head cutter disposed on the rod; and a burst disc disposed in the outlet port and adjacent the broad head cutter, wherein the broad head cutter is further configured to extend at least partially through the burst disc when the rod moves from the first position to the second position.

13. The system of claim 7 further comprising a stop member coupled to the rod between the inlet port and the electric actuator, the stop member being in contact with the inlet port when the rod is in the second position.

14. An automatic fire extinguishing system comprising:

a canister having a central axis;

an outlet port disposed on the canister;

a dip tube disposed in the canister about the central axis and in partial fluid communication with the canister and coupled to the outlet port;

a rod extending axially through the dip tube and operably coupled to the canister opposite the outlet inlet port, the rod movable from a first position to a second position;

a propellant gas mixture disposed within the canister;

a gaseous fire suppression agent disposed in the canister, wherein a diameter of the outlet port is sized relative to a pressure of the propellant gas mixture to discharge when the rod is in the second position a mixture of the propellant gas mixture and gaseous fire suppression agent from the outlet port within predetermined confined space limitations;

an electric actuator coupled to the canister opposite the outlet port, the electric actuator further being operably coupled to move the rod from the first position to the second position;

a ring member coupled to the rod within the dip tube, wherein the dip tube further includes a plurality of holes, the plurality of holes being closed by the ring member when the rod is in the first position and the plurality of holes being open when the rod is in the second position;

an inlet port coupled to an end of the dip tube opposite the outlet port; and semi-permeable membrane disposed over the inlet port, the semi-permeable membrane configure to move from a closed position to an open position when the propellant gas mixture is discharged in operation.

15. The system of claim 14 further comprising a stop member coupled to the rod between the inlet port and the electric actuator, the stop member being in contact with the inlet port when the rod is in the second position.

* * * * *